United States Patent [19]

Sigrist

[11] 4,389,938

[45] Jun. 28, 1983

[54] ILLUMINATING ROCKET POSSESSING A CYLINDRICAL CONTAINER

[75] Inventor: Hugo Sigrist, Hinwil, Switzerland

[73] Assignee: Werkzeugmaschinenfabrik Oerlikon-Bührle AG, Zurich, Switzerland

[21] Appl. No.: 249,214

[22] Filed: Mar. 30, 1981

[30] Foreign Application Priority Data

Apr. 22, 1980 [CH] Switzerland ..... 3087/80

[51] Int. Cl.[3] ..... F42B 4/28

[52] U.S. Cl. ..... 102/337; 102/340; 102/342; 102/345; 102/481

[58] Field of Search ..... 102/323, 328, 329, 337, 102/340, 342, 343.5, 473, 481, 493; 89/1.817, 31

[56] References Cited

U.S. PATENT DOCUMENTS

| | | | |
|---|---|---|---|
| 2,024,247 | 12/1935 | Officer | 102/328 |
| 3,031,932 | 5/1962 | Fite, Jr. . | |
| 3,420,173 | 1/1969 | Slawinski et al. | 102/323 |
| 3,735,706 | 5/1973 | Elstow et al. | 102/340 |
| 3,742,814 | 7/1973 | Krol | 89/1.817 X |
| 3,851,561 | 12/1974 | Zagala et al. | 89/1.817 X |
| 3,962,951 | 6/1976 | Schenk | 89/1.817 X |

FOREIGN PATENT DOCUMENTS

| | | | |
|---|---|---|---|
| 2419348 | 10/1975 | Fed. Rep. of Germany . | |
| 2639719 | 3/1978 | Fed. Rep. of Germany . | |
| 2230955 | 12/1974 | France . | |
| 2455724 | 1/1981 | France | 89/1.817 |
| 411628 | 11/1966 | Switzerland . | |
| 576616 | 6/1976 | Switzerland . | |
| 1364405 | 8/1974 | United Kingdom . | |

*Primary Examiner*—Peter A. Nelson

*Attorney, Agent, or Firm*—Werner W. Kleeman

[57] ABSTRACT

Within a cylindrical container or canister, closed at both ends by a respective cover member, there is located a flare or illuminating rocket. For firing the flare rocket it is sufficient to remove the rear cover and by pulling at a tear line there is activated a tear ignition device or fuze. The ignited flare rocket then pierces the front cover member. This front cover member preferably possesses a ring-shaped or annular reference fracture location which subdivides the cover member into a disk-shaped inner portion and a ring-shaped outer portion.

4 Claims, 3 Drawing Figures

ILLUMINATING ROCKET POSSESSING A CYLINDRICAL CONTAINER

BACKGROUND OF THE INVENTION

The present invention relates to a new and improved construction of illuminating projectile, such as a flare or illuminating rocket, containing a cylindrical canister or container closed at its front by an end wall and at its rear by a removable cover member.

With a state-of-the-art illuminating or flare rocket of this type there are provided at the container, both at the front and rear, a respective threadably releasable cover. Prior to firing the flare rocket it is necessary to remove the front cover, so that the flare rocket can be launched out of the forward end of the container. It is necessary to remove the rear cover so that the tear fuze or ignition device can be activated. This tear fuze possesses a tear line or cord where a pulling action must be exerted in order to trigger the fuze and which is first then accessible when the rear cover has been removed.

If the operator of such flare rocket forgets to remove the front cover or cover member, then the rocket can not be propelled out of the container or canister. The flare rocket therefore becomes non-functional and does not fulfill its assigned tasks.

SUMMARY OF THE INVENTION

Therefore, with the foregoing in mind it is a primary object of the present invention to provide a new and improved construction of flare projectile, such as a flare rocket, which is not associated with the aforementioned drawbacks and limitations of the prior art proposals heretofore discussed.

Another and more specific object of the present invention aims at providing a new and improved construction of a flare rocket possessing a container or canister, wherein operation of the flare rocket is simplified in order to avoid faulty or erroneous operator manipulations, and it is no longer necessary for the operator to open the container at its front region.

Now in order to implement these and still further objects of the invention, which will become more readily apparent as the description proceeds, the flare rocket of the present development is manifested by the features that the container, at its front region or end, can be fractured or ruptured by the ignited flare rocket.

Preferably between the container and the flare rocket there is provided an accelaration path so that the flare rocket, when launched, possesses kinetic energy for rupturing the container. The front end wall of the container can be designed to be resilient or elastic and can be bent-out through the aforementioned acceleration path by the thrust force of the ignited flare rocket.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
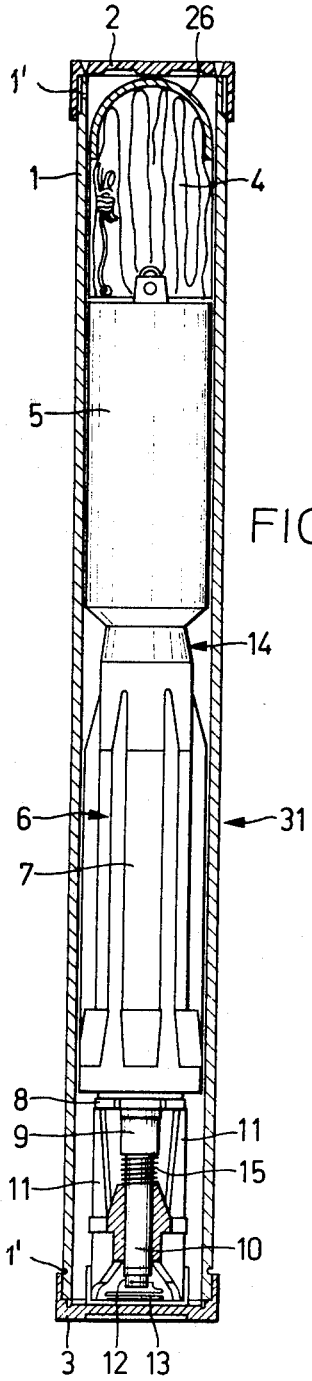
FIG. 1 is a longitudinal sectional view through the container and flare or illuminating rocket constructed according to the invention.

Describing now the drawings, in FIG. 1 there is shown an exemplary embodiment of illuminating projectile, here a rocket, composed of a container or canister 31 possessing a substantially cylindrical tube 1 which is provided at both ends with respective external threads or threading, as generally indicated by reference character 1'. This tube 1 is closed at both ends by the two covers or cover members 2 and 3 which are threaded onto the aforementioned external threads 1'.

Internally of the container 31 there is located an illuminating or flare rocket 14. Since this flare rocket 14 is of known construction and is not subject matter of the present development, it will only be described hereinafter to the extent necessary for one skilled in the art to readily understand the underlying principles of the invention.

This flare rocket 14 possesses a parachute 4 at which there is attached a flare or candle charge 5. Secured rearwardly of the flare charge 5 is a drive or propulsion mechanism 6 which contains a drive or propulsion charge 7. The drive or propulsion mechanism 6 is provided at its rear end with a nozzle 8. Behind this nozzle 8 there is located a fuze 9 which in conventional manner can be punctured by a not particularly illustrated firing pin or equivalent structure. This standard firing pin is located within a housing 10 which is attached by rib members 11 at the rear end of the tube 1 at its inner wall. At the rear end 12 of the firing pin there is arranged a tear line or cord 13 or equivalent structure. Upon pulling the tear or draw line 13 the firing pin is caused to contact the fuze 9 and the illuminating or flare rocket 14 is ignited. A spring 15 strives to urge the flare rocket 14 against the front cover or cover member 2.

Figure 2:
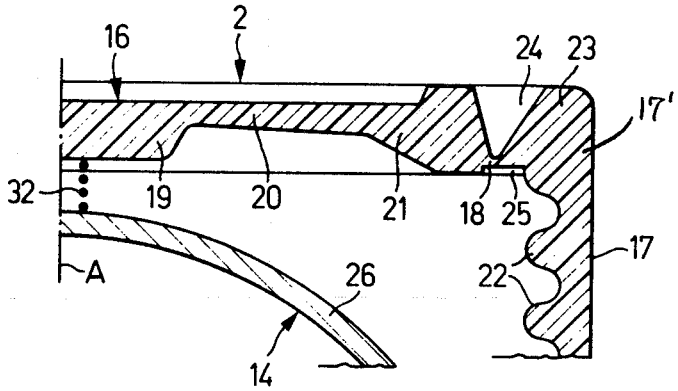
FIG. 2 is a fragmentary sectional view, on an enlarged scale, through the front cover or cover member.

As to this front cover member 2, the construction of which has been carried out in accordance with the teachings of the invention and will be apparent by referring to FIG. 2. The axis A—A of the cover member 2 coincides with the lengthwise axis of the flare rocket 14. This cover or cover member 2 consists of a substantially disk-shaped inner portion 16 and a ring-shaped or annular outer portion 17. These cover portions 16 and 17 are interconnected by means of a reference fracture or break location 18. The plate or disk-shaped inner portion 16 is provided at its central region with a substantially disk-like enlarged or thickened portion 19 which transforms into a ring-shaped, relatively thin portion or section 20 at which there then merges an appreciably thicker edge or marginal region 21. By means of the thin portion or section 20 it is possible for the disk-shaped inner part or portion 16 of the cover member 2 to perform a relatively pronounced resilient or spring action, i.e. to bow in a spring-like manner.

The ring-shaped outer part or portion 17 of the cover member 2 is essentially cylindrical and is provided at its inner wall with internal threads or threading 22 by means of which the cover member 2 can be screwed onto the front external threads 1' of the tube or barrel 1. At the front end 17' of the ring-shaped outer cover part or portion 17 there is provided a thicker margin or edge region 23 which is connected by means of a reference fracture location 18 with the thick marginal region or edge 21 of the disk-shaped inner part or portion 16 of the cover member 2. The reference fracture or break location 18 is formed at its front by a groove or depression 24 of substantially V-shaped cross-sectional configuration and at its rear by a substantially flat rectangular groove or depression 25 or the like. The thickness of the reference fracture location 18 is selected in accordance with the desired fracture load. Preferably the reference fracture location has a thickness in the order of 0.18 to 0.20 mm. It is desirable if the front cover member 2 can resiliently yield or bend through a distance of about 2.3 mm, i.e. when the flare rocket 14 under the action of the thrust force presses with its forward spherical portion 26 (FIG. 1) against the front cover member 2 the disk-shaped inner part 16 of the cover member 2 bends-through and the disk-like part or portion 19 is displaced forwardly through a distance amounting to the aforesaid value 2.3 mm.

Figure 3:
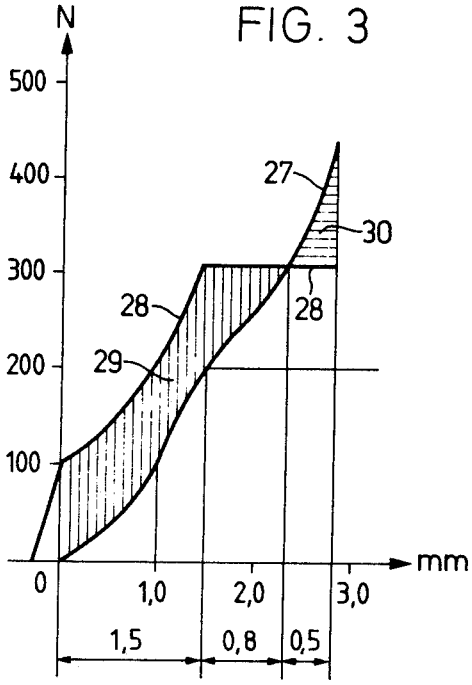
FIG. 3 is a diagram illustrating the forces as a function of the stroke or resilient action of the cover.

By referring to FIG. 3 there will now be explained what happens upon launching of the flare rocket:

In FIG. 3 there has been illustrated the spring or resilient characteristic 27 of the front cover member 2. From this spring characteristic 27 it will be apparent that the cover member 2 tends to yield at its center point through a distance of about 2.8 mm, and that there is needed for such resilient yielding or stroke a thrust and pressure force of about 45 kp, i.e. 450 Newtons (N). It is here remarked that a kilopound (kp) amounts to 9.81 Newtons.

Further, by again reverting to FIG. 3 it will be recognized that the flare rocket 14, when ignited, develops a dynamic thrust force of about 100 N. The static thrust force is measured at approximately 300 N.

Since the flare rocket 14, upon ignition of the propulsion mechanism 6, presses against the cover member 2 the dynamic thrust force of the propulsion charge 27 increases in accordance with the line or curve 28 of the rocket thrust to the static thrust force of 300 N. It is assumed that upon reaching the static thrust force of 300 N the flare rocket 14 has displaced through a distance of about 1.5 mm, as is apparent from the diagram of FIG. 3.

The flare rocket 14, during such displacement, has been accelerated and thus possesses kinetic energy. This kinetic energy, corresponding to the vertically shaded area 29, and the static thrust force of the propulsion or drive mechanism 7, are collectively capable of rupturing the cover member 2 along the reference fracture location or line 18, although the static thrust force is smaller than the pressure or compressive force which is needed for fracturing the disk-shaped inner part 16 along the reference fracture location 18.

It is assumed that with a resilient yielding action of the cover member 2 of 2.3 mm the required compressive force just is of the same magnitude as the static thrust force of the flare rocket 14, i.e. both of the lines or curves 27 and 28 intersect during a resilient yielding of 2.3 mm and a force of 300 N.

In order to obtain the required rupture or fracture load, i.e. the aforementioned pressure or compressive force of 450 N for fracturing the cover member 2 there is thus required the kinetic energy of the flare rocket 14. After the cover member 2 has already resiliently yielded through a distance of about 2.3 mm, there is still required work according to the horizontal shaded surface 30. Since this work for fracturing the cover member 2, as shown by the second surface or area 30, is appreciably smaller than the kinetic energy of the flare rocket 14 as represented by the first surface or area 29, the flare rocket 14 will surely penetrate through the cover member 2.

The use of the kinetic energy of the flare rocket 14 therefore enables designing the cover member 2 so as to be appreciably stronger then if there only were available the static thrust force for puncturing the cover member 2. Instead of providing an acceleration path for the flare rocket 14 through the provision of a resiliently yielding or spring-like acting cover member 2, as was the case with the described exemplary embodiment, it is also possible according to a modification of the invention to provide between the cover member 2 and the flare rocket 14 a certain spacing, as indicated in FIG. 2. Between the flare rocket 14 and the cover member 2 there also can be arranged a spring member 32, as shown in FIG. 2. Upon ignition of the flare rocket 14 it is first necessary to compress the spring member 32, and as a result there is imparted to the flare rocket 14 the kinetic energy needed for the flare rocket 14 to break out of the container or canister 31. Since the cover member 2 no longer need be detachable it also can be fixedly connected with the cylindrical tube 1 of the container or canister 31.

While there are shown and described present preferred embodiments of the invention, it is to be distinctly understood that the invention is not limited thereto, but may be otherwise variously embodied and practiced within the scope of the following claims. Accordingly,

I claim:

1. A flare rocket arrangement comprising:

a substantially cylindrical container having a front portion and a rear portion;

means defining an end wall for closing said front portion;

a removable cover member provided at the rear portion;

a flare rocket arranged within said container;

said container being rupturable at said end wall at said front portion when the flare rocket is ignited;

said container and flare rocket being arranged such that between the container and flare rocket there is provided an acceleration path, so that the flare rocket, when ignited, develops sufficient kinetic energy for rupturing the container;

the front end wall of the container being constructed to be resiliently yielding and can be bent-through by an amount corresponding to said accleration path due to the action of thrust forces of the ignited flare rocket;

said front end wall of the container possesses a substantially ring-shaped reference fracture location and a substantially disk-shaped inner portion;

said reference fracture location delimiting said ring-shaped inner portion;

the diameter of said inner portion being selected such that after rupturing said disk-shaped inner portion of said front end wall the ignited flare rocket can depart from said container;

said means defining said end wall comprises a threadable cover member provided for said container;

said threadable cover member being subdivided by said reference fracture location into said disk-shaped inner portion and said ring-shaped outer portion; and said reference fracture location comprises a front substantially ring-shaped groove of substantially V-shaped configuration in cross-section and a rear, substantially ring-shaped groove of substantially rectangular shape in cross-section.

2. A flare rocket arrangement comprising:

a substantially cylindrical container having a front portion and a rear portion;

means defining an end wall for closing said front portion;

a removable cover member provided at the rear portion;

a flare rocket arranged within said container;

said container being rupturable at said end wall at said front portion when the flare rocket is ignited;

said container and flare rocket being arranged such that between the container and flare rocket there is provided an acceleration path, so that the flare rocket, when ignited, develops sufficient kinetic energy for rupturing the container;

the front end wall of the container being constructed to be resiliently yielding and can be bent-through by an amount corresponding to said acceleration path due to the action of thrust forces of the ignited flare rocket;

said front end wall of the container possesses a substantially ring-shaped reference fracture location and a substantially disk-shaped inner portion;

said reference fracture location delimiting said ring-shaped inner portion;

the diameter of said inner portion being selected such that after rupturing said disk-shaped inner portion of said front end wall the ignited flare rocket can depart from said container; and said reference fracture location comprises a front substantially ring-shaped groove of substantially V-shaped configuration in cross-section and a rear, substantially ring-shaped groove of substantially rectangular shape in cross-section.

3. The flare rocket arrangement as defined in claim 2, wherein:

a space is maintained between said front end wall of the container and said flare rocket for forming said acceleration path.

4. The flare rocket arrangement as defined in claim 3, further including:

a spring arranged in the space between the front end wall of the container and the flare rocket.

* * * * *